United States Patent [19]

Aschberger

[11] 3,935,647

[45] Feb. 3, 1976

[54] ULTRAVIOLET CURING OVEN

[75] Inventor: Anton A. Aschberger, Youngstown, Ohio

[73] Assignee: Continental Can Company, Inc., New York, N.Y.

[22] Filed: July 16, 1974

[21] Appl. No.: 489,055

[52] U.S. Cl. ..... 34/105; 34/1; 34/229; 34/236; 219/388; 432/122

[51] Int. Cl.² ..... F26B 25/00

[58] Field of Search ..... 34/1, 4, 105, 208, 218, 34/229, 230, 233, 236; 219/388, 377; 198/131; 432/122, 153, 162, 42

[56] References Cited

UNITED STATES PATENTS

| | | | |
|---|---|---|---|
| 2,376,161 | 5/1945 | Maud et al. | 198/131 |
| 2,664,282 | 12/1953 | Mann | 432/42 |
| 3,045,358 | 7/1962 | Breakell et al. | 34/105 |
| 3,808,702 | 5/1974 | Laessig | 34/218 |
| 3,840,999 | 10/1974 | Whelan | 34/105 |

*Primary Examiner*—Kenneth W. Sprague
*Assistant Examiner*—James C. Yeung
*Attorney, Agent, or Firm*—Diller, Brown, Ramik & Wight

[57] ABSTRACT

This disclosure is directed to an ultraviolet curing oven particularly adapted for drying one piece bodies of two piece cans, the oven including a housing through which passes a conveyor carrying a plurality of brushes for supporting the can bodies thereon and means for rotating the brushes to thereby rotate the can bodies past ultraviolet lamps to dry or cure the can bodies which had earlier been base coated.

The brushes are rotated through the use of a stationary chain meshing with a sprocket carried by each brush.

The ultraviolet lamps are disposed in pairs generally but not perfectly parallel to the direction of can body travel through the oven, and means are provided for rotating the ultraviolet lamps both toward and away from the can bodies so that particularly in the latter case the can bodies and/or brushes will not be burned or scorched should stoppage of the conveyor occur for any reason.

20 Claims, 13 Drawing Figures

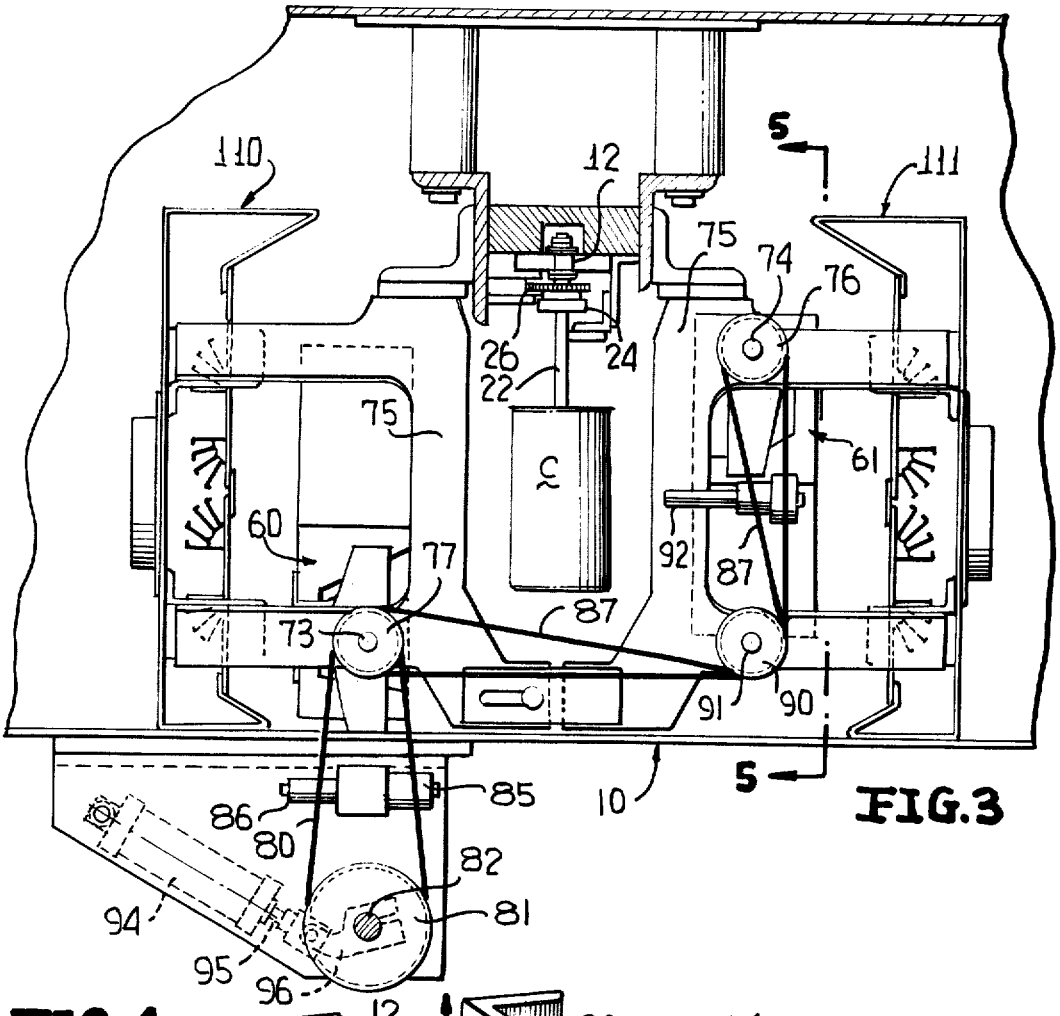
FIG.3
FIG.4
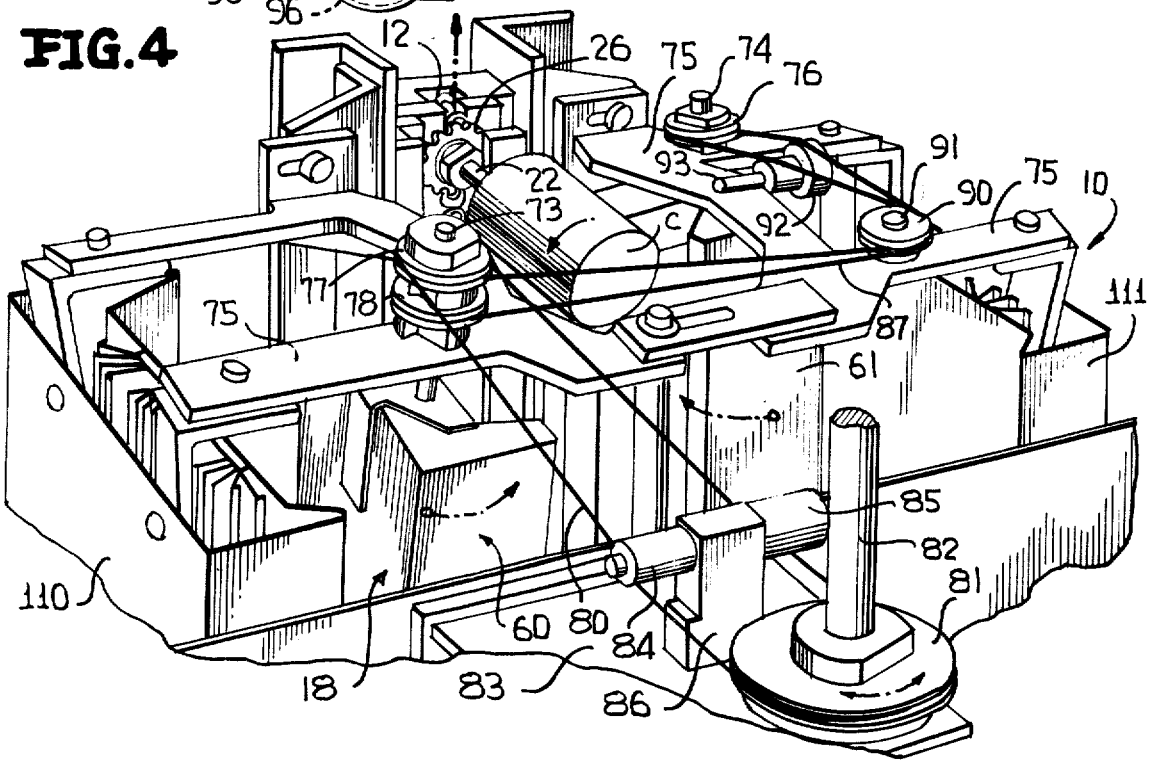

FIG. 11
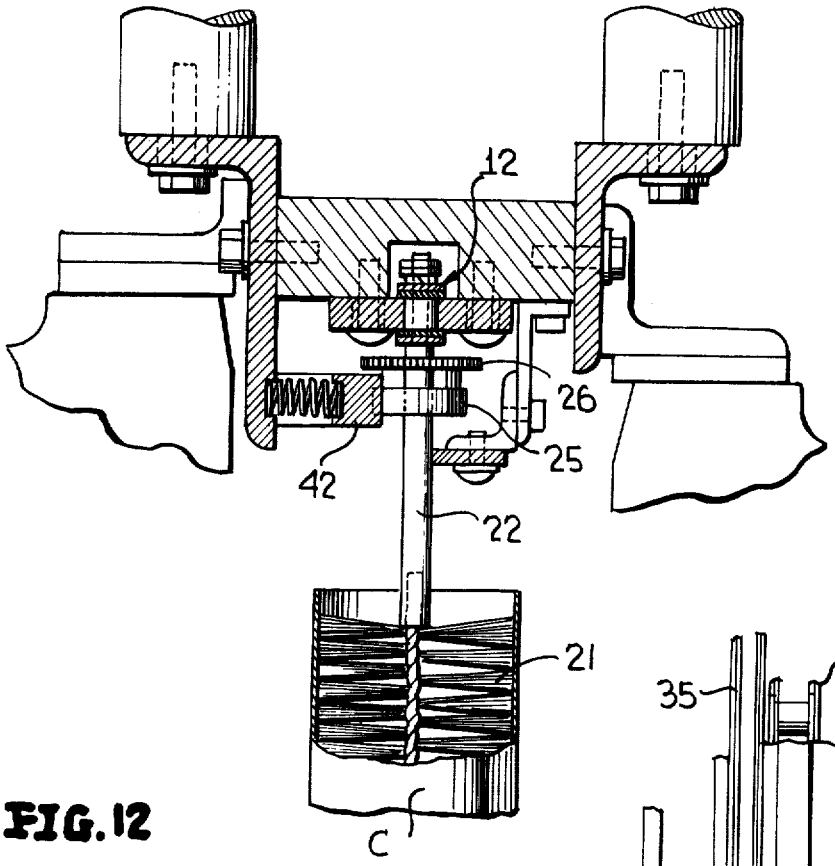
FIG. 12
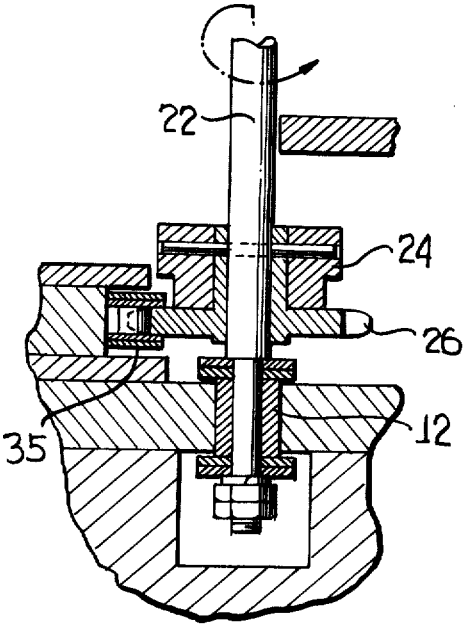
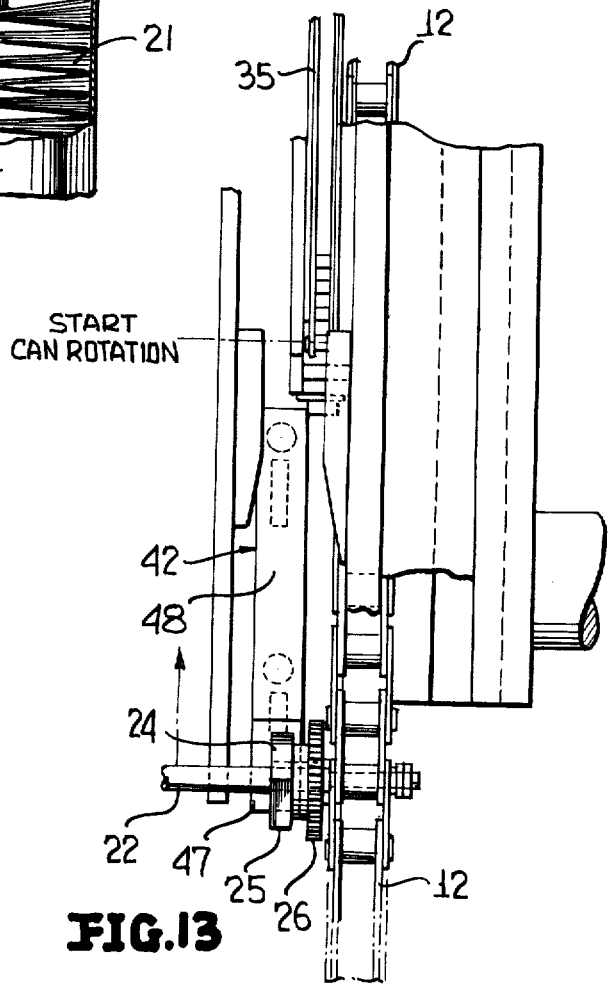
FIG. 13

ULTRAVIOLET CURING OVEN

In keeping with the present invention one piece can bodies are conventionally fed onto brushes of a conveyor chain which passes through a conventional can coater. Thereafter the chain conveyor conveys the base coated can bodies into the novel ultraviolet curing oven of this invention during which the can bodies are subjected to the heat and ultraviolet rays of two pair of ultraviolet lamps resulting in the rapid curing or drying of the base coated can bodies and the subsequent unloading thereof for subsequent processing.

In keeping with a primary object of this invention the can bodies are rotated as they pass the ultraviolet lamps and this is achieved by providing each brush with a shaft having secured to it a sprocket which in turn meshes with a chain positioned generally parallel and adjacent the path of travel of the conveyor chain as it moves between the pairs of ultraviolet lamps whereby rotation is imparted to the sprocket and in turn to the brushes and the can bodies carried thereby.

In keeping with still another object of this invention the rotation imparting chain is held stationary at one end but at its opposite end a spring mounts the chain to the oven frame such that the rotation imparting chain may shift slightly in the direction of conveyor travel to compensate for any initial infeed misalignment between the rotation imparting chain and the sprockets carried by the brushes.

Another object of this invention is to provide a novel apparatus of the type described wherein the pairs of ultraviolet lamps have longitudinal axes disposed along but askew to the path of travel imparted to the can bodies by the conveying means, and means are provided for rotating the pair of ultraviolet lamps through 180 degrees thereby redirecting the normal direction of heat application away from the path of travel to prevent heat damage to the can bodies should there be a stoppage in the conveying means for any reason whatever.

Still another object of this invention is to provide a novel ultraviolet curing oven or dryer of the type described and a single source which, is preferably though not necessarily a fluid or pneumatic cylinder, imparts the rotation to the two pairs of ultraviolet lamps through novel cable and shaft linkage means.

Wtih the above and other objects in view that will hereinafter appear, the nature of the invention will be more clearly understood by reference to the following detailed description, the appended claimed subject matter, and the several views illustrated in the accompanying drawing.

In the drawings:

FIG. 3 is an enlarged sectional view taken generally along line 3—3 of FIG. 2, and illustrates details of a cable system for imparting rotation to the ultraviolet lamps.

FIG. 4 is a fragmentary perspective view of the structure shown in FIG. 3, and illustrates further details thereof.

FIG. 11 is an enlarged fragmentary sectional view taken generally along line 11—11 of FIG. 8, and illustrates further details of the construction thereof including guide means for each can body holder as it passes through the ultraviolet curing oven.

FIG. 12 is an enlarged fragmentary sectional view taken generally along line 12—12 of FIG. 8, and illustrates the manner in which rotation is imparted to each can body holder through its sprocket and the stationary chain or track.

FIG. 13 is an enlarged sectional view taken generally along line 13—13 of FIG. 8, and illustrates further details of the can body infeed section of the oven.

Figure 1:
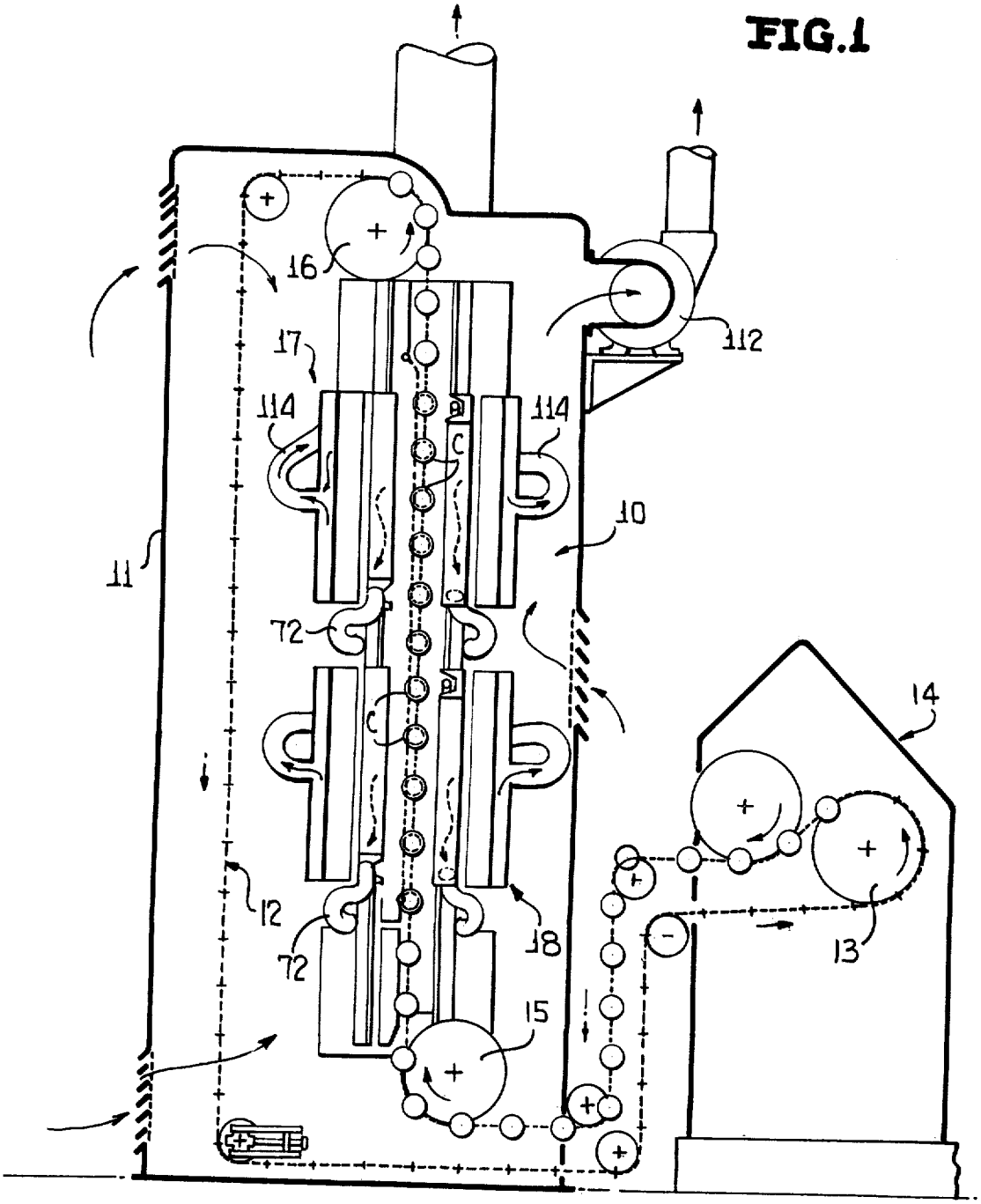
FIG. 1 is a highly schematic side view, and illustrates a continuous chain conveyor carrying brushes upon which are carried can bodies for passage from a can coater through two pairs of ultraviolet lamps of an ultraviolet curing oven.

A novel ultraviolet curing oven particularly adapted for curing or drying base coated one piece can bodies in generally designated by the reference numeral 10 (FIG. 1) and includes a housing 11 through which passes conveying means in the form of a conveying chain 12. The conveying chain 12 is driven by suitable means as, for example, a variable speed motor connected to a drive sprocket 13 of a can body coater 14 of a conventional construction. The can bodies are fed to the conveyor 12 prior to the same moving into the coater 14 and outwardly therefrom after they have been base coated in a conventional manner. Thereafter the conveyor chain 12 is guided by suitable sprockets to a lower main sprocket 15 and an upper main sprocket 16 between which are two pair of ultraviolet lamps 17, 18 which cure the base coating during the passage of the can bodies therebetween by the conveyor 12 after which the can bodies are removed by a suitable unloading mechanism 20 (FIG. 2) such as a 6920U-1 oven unloader.

Figure 7:
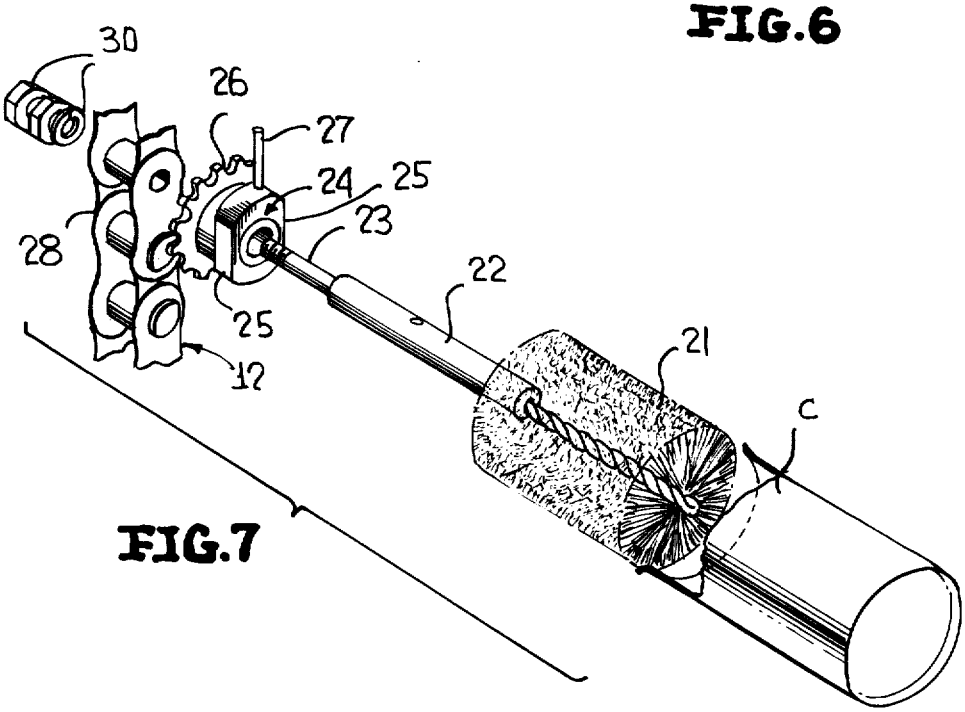
FIG. 7 is an exploded perspective view, and illustrates details of the can body holder including a sprocket carried thereby and a flat surface cam for aligning the sprocket teeth with a stationary chain during initial infeed to the curing oven.

Reference is now made to FIG. 7 which shows details of the conveyor chain 12 and specifically the manner in which the same is provided with a plurality of can body supports in the form of a wire brush 21 having a diameter slightly greater than the internal diameter of each can body C such that as each can body C is fed upon the brush 21 the individual wires or brissles thereof deform slightly to insure retention of the can C thereupon. A stem 22 of the holder or brush 21 has a threaded end portion 23 which is slightly reduced and receives thereon a cam member 24 having opposite parallel flat cam surfaces 25. The cam element 24 is fixed to a sprocket 26 by a suitable pin 27 or the like. The stem 23 of each holder 21 is thereafter passed through suitable bores 28 of individual links (unnumbered) of the chain 12 and fastened therein by lockwashers, nuts, or the like, generally designated by the reference numeral 30. In this fashion the conveyor 12 is provided with a plurality of can body holders in the manner most evident from FIGS. 1, 2 and 8 of the drawings for moving the can bodies C pass the two pair of ultraviolet lamps 17, 18.

During the movement of the can bodies C pass the pair of ultraviolet lights 17, 18, the holders are rotated to make certain that the can body exteriors are uniformally subjected to the ultraviolet radiation. The manner of imparting rotation to each of the holders 21 is by bringing each sprocket 26 into mesh with a stationary chain or track 35 in a manner most readily apparent from FIGS. 8 through 13 of the drawings. The chain 35 is fastened at an upper end (FIG. 8) by a suitable bracket 36 to one of a pair of angle iron members 37,38, forming a portion of the overall machine frame (unnumbered). Bracket 36 is preferably bolted to the angle member 37 in such a way to permit vertical motion for adjustment purposes in a conventional manner as, for example, passing the bolt through an elongated slot of the bracket 36 (not shown). The lower end of the track 35 is similarly rigidly connected to the machine frame by a bolt or the like 40 (FIG. 9) or alternately the lower end of the chain 35 may be connected to a relatively stiff spring which in turn is suitably connected to the frame. The purpose of such spring is to permit slight give to the chain 35 should the sprocket teeth not align perfectly as they are introduced to the links of the chain 35 by upward motion of the conveyor 12, as viewed best in FIGS. 8 and 9 of the drawings.

Figure 8:
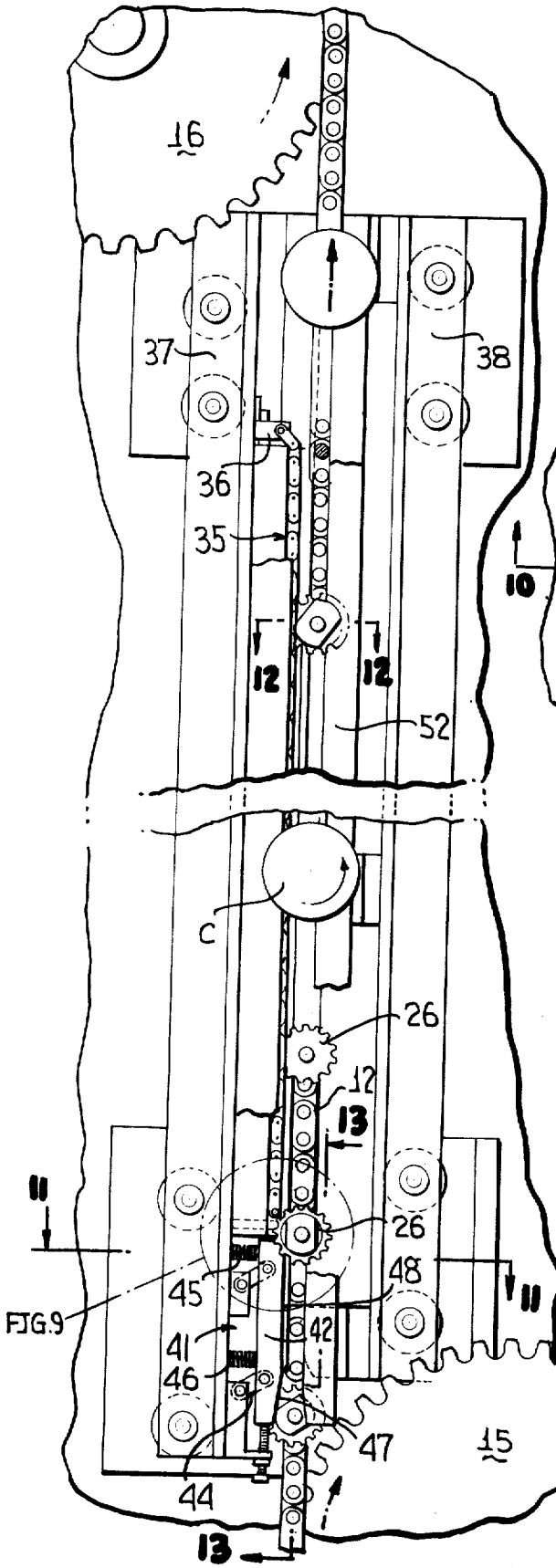
FIG. 8 is a fragmentary side elevational view of the curing oven similar to FIG. 1, and illustrates details of a cam for contacting the cam member carried by each can body holder on the main conveyor chain for aligning the teeth of each sprocket with a stationary chain disposed generally parallel to the main conveyor chain.
Figure 9:
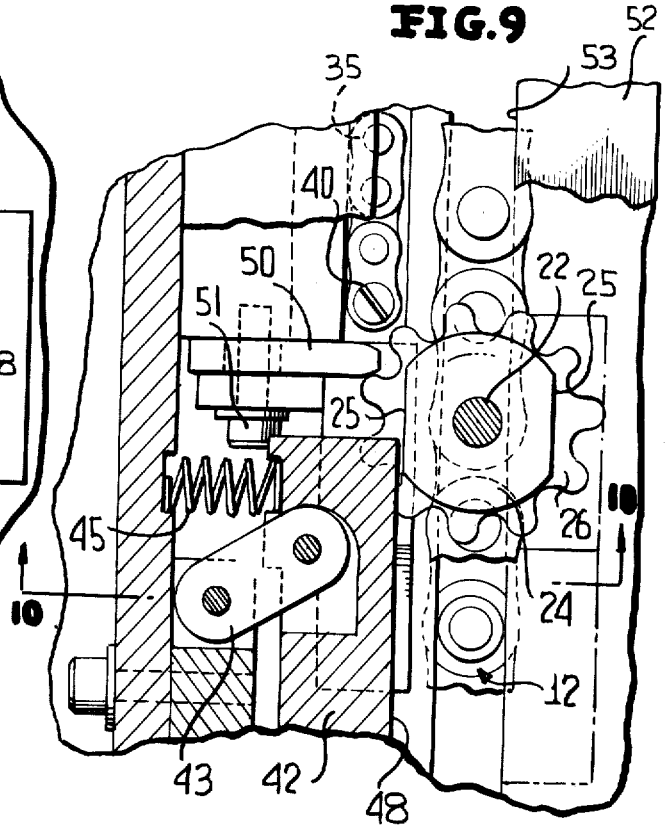
FIG. 9 is an enlarged fragmentary view of the encircled portion of FIG. 8, and illustrates with more clarity the manner in which the teeth of the illustrated sprocket are about to register with the pins of the stationary track or chain.

In order to assure alignment or alternatively compensate for misalignment which might otherwise occur the entrace end (unnumbered) of the machine adjacent the sprocket 15 (FIG. 8) is provided with alignment means generally designated by the reference numeral 41. The alignment means 41 includes an alignment bar 42 connected by a pair of links 43 (FIG. 9), 44 (FIG. 8) to a pair of blocks (unnumbered) which are in turn secured to the angle bar 37. A pair of springs 45 (FIGS. 8 and 9) and 46 (FIG. 8) biased the bar 42 to the right as viewed in FIGS. 8 and 9. The bar includes a tapered cam surface 47 (FIG. 8) and a relatively longer surface 48 which parallels the path of travel of the chain 12 as it passes upwardly between the sprockets 15,16 as is best viewed in FIG. 8. As may be best visualized from FIGS. 8 and 13 of the drawings, either flat surface 25 of each cam member 24 will contact the cam surface 47 of the bar 42 as upward motion occurs during the travel of the chain 12 between the sprockets 15,16. The surfaces 25,27 interact resulting in the rotation of the cam member 24 and, of course, each sprocket 27 secured thereto. The surface 25 subsequently merges in parallel relationship with the surface 28 of the bar 42 with the result that as each can body holder 21 departs the surface 48 of the bar 42, much in the manner illustrated in FIG. 9, the teeth of the sprocket will be positioned for meshing engagement with the chain 35. However, rather than directly being meshed after departing the bar 42 a tooth (unnumbered) of each sprocket contacts a resilient finger 50 formed of relatively hard rubber (60 durometer) joined to the frame by a suitable bolt 51. The finger 50 thus imparts initial counter-clockwise rotation, as viewed in FIG. 9, to each sprocket resulting in the tooth leading the tooth contacting the finger 50 to drop into a gap between the last link and the finger 50 and the next following tooth to mesh correctly with the first link of the chain 35. Thereafter as the conveyor chain 12 moves in a direction toward the sprocket 16 the sprockets carried by the chain 12 since now meshing with the chain 35 which is stationary will be continuously rotated until passing beyond the upper end of the chain 35 generally in the area of the bracket 36 (FIG. 8). In this manner each can C carried by a holder 21 will be rotated several times during its passage between the pair of ultraviolet lamps 17,18 to assure uniform application of ultraviolet rays upon the base coating on the containers exterior cylindrical surface.

Figure 10:
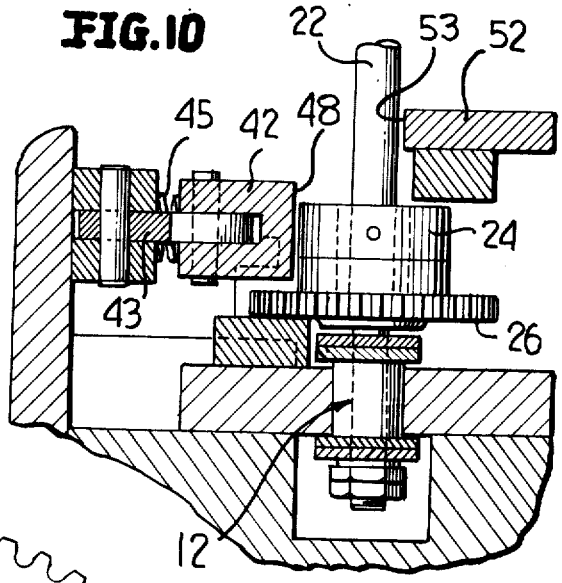
FIG. 10 is an enlarged fragmentary sectional view taken generally along line 10—10 of FIG. 9, and illustrates further details of construction of the structure of FIG. 9.

During the movement of the chain 12 between the sprockets 15,16 each sprocket 26 must be maintained in meshing relationship with the chain 35, and to this end a guide 52 suitably secured to the angle bar 38 (FIGS. 8 and 9) extends generally the length of the chain 35 with a surface 53 thereof being parallel to the chain 35 as well as that portion of the chain 12 between the sprockets 15,16. The surface 53 is closely adjacent each stem 22 (FIG. 10) and therefore any tendencey of the sprocket 26 carried by each stem 22 to move to the right, as viewed in FIG. 10, is opposed by the surface 53 thereby maintaining meshed engagement and assuring rotation of the holders 21 in the manner most readily apparent in FIGS. 11 and 12.

Figure 5:
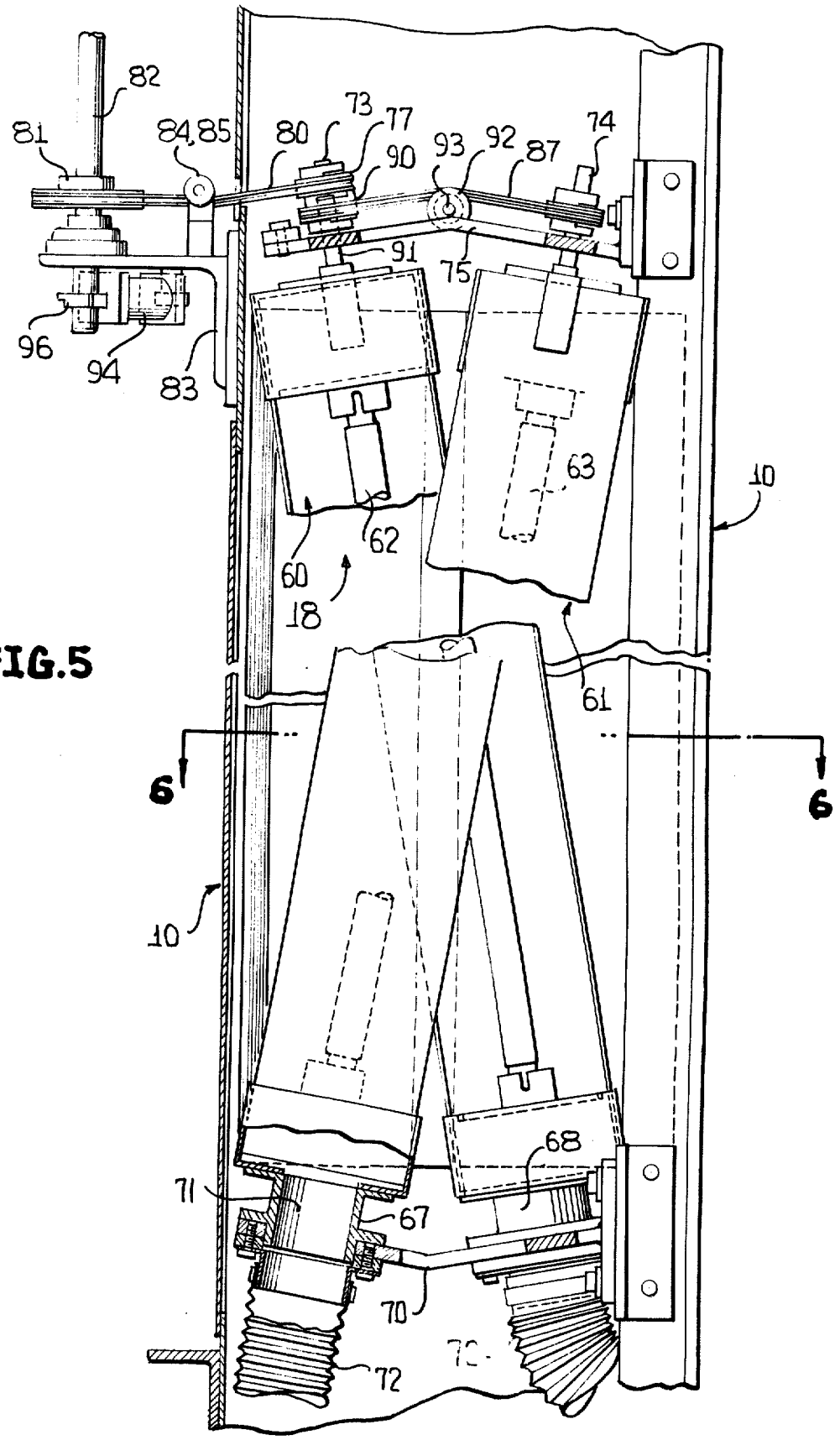
FIG. 5 is a fragmentary sectional view taken along line 5—5 of FIG. 3, and illustrates the askewed mounting of one of the pair of ultraviolet lamps relative to the unillustrated path of conveyor travel, as well as details of the cable mechanism for rotating the lamps.
Figure 6:
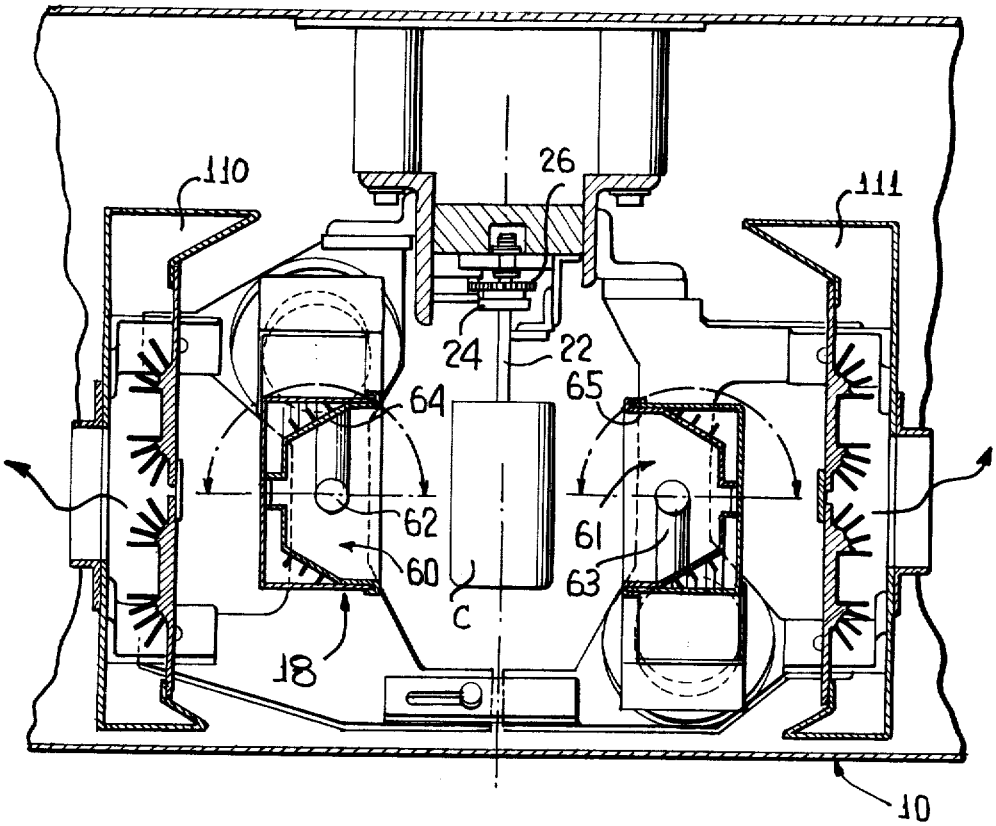
FIG. 6 is a cross-sectional view taken generally along line 6—6 of FIG. 5, and illustrates one of the two pair of ultraviolet lamps directed toward a can body carried by a brush on the conveyor chain.

The pairs 17,18 of ultraviolet sources or lamps are identical, as are means to be described hereinafter for operating the same. Hence the following description of the pair 18 is equally applicable to the pair 17. The pair 18 of ultraviolet lamps includes two conventionally produced ultraviolet lamps 60, 61 (FIGS. 5 and 6) having florescent or like tubes of ultraviolet radiation which are generally designated by the reference numerals 62,63, respectively. The tube 62,63 are in conventional housings which include reflector surfaces 64, 65 which normally oppose each other (FIG. 6) and direct ultraviolet energy toward the can bodies C carried by the chain or conveyor 12 between the sprockets 15 and 16. The longitudinal axis of the ultraviolet lamps 60,61 are slightly askewed or tilted relative to each other and to the direction of travel of the can bodies C therebetween in the manner readily apparent from FIGS. 2,5 and 6 of the drawings.

The lamps 60,61 are suitably mounted for rotation in lower bushings 67,68, respectively, carried by a bracket 70 secured to the machine frame. Lower tubular ends 71 of each lamp 60,61 are tubular and are received in the bearings or bushings 67,68. The lower ends are tubular in order that flexible conduits 72 may be suitably attached to the bracket 70 and draw hot air from the interior of the lamps 60,61 to preclude undesired heat build-up, can body scorching, brush burning, etc.

Upper ends of the lamps 60,61 carry shafts 73,74, respectively, which are suitably journaled in a bracket 75 secured to the machine frame (unnumbered). The shaft 74 has keyed thereto a grooved wheel or pulley 76 while the shaft 73 has keyed thereto a pair of grooved wheels or pulleys 77,78. A first cable 80 (FIGS. 3 and 4) is entrained about the pulley 77 and a pulley 81 keyed to a vertical shaft 82 journaled for rotation in a bracket 83 mounted to the machine frame. The cable 80 passes beneath a pair of guide rollers 84,85 suitably connected by a post 86 to the bracket 83. Another cable 87 is entrained about the pulleys 76,78 and another groove wheel or pulley 90 keyed to a shaft 91 which is in turn suitably fixed to the frame 75. The cable 87 is guided by a stepped guide pulley 92 carried by a shaft 93 secured to another portion of the frame 75.

A pneumatic cylinder 94 is connected beneath the bracket 83 and its piston rod 95 is connected by a bifurcated yoke 96 to the shaft 82. As the piston rod 95 is extended from the cylinder 94 by conventional means the yoke 96 rotates the shaft 82 which in turn rotates the pulley 81 through 90° of rotation which can be established by suitable stops or like conventional limiting means. However, since the ratio of the pulley 81 to the pulley 77 is two-to-one for 90° of rotation of the pulley 81 the shafts 73,74 rotate 180° which will rotate the lamps 60,61 a like 180° in the manner deplicted by the double headed unnumbered arrows in FIG. 6 which in effect directs the radiation emitted from the florscent tubes 62,63 directly 180° opposite that illustrated in FIG. 6 and thus away from the can C therebetween. Preferably the fluid cylinder 94 is operated through a heat sensing switch and a solenoid (not shown) such that should the conveyor 12 cease to operate for one reason or another, particularly the flight thereof between the sprockets 15,16, the lamps 60,61 will be directed away from the cans C so that the latter as well as any brushes 21 not carrying a can body C thereon will neither be scorched, burned, or otherwise damaged. At the same time conventional control means are provided for reducing or completely terminating electrical power to the lamps 62,63 to reduce the heat emitted in the oven when the container bodies C are not moving therethrough.

Figure 2:
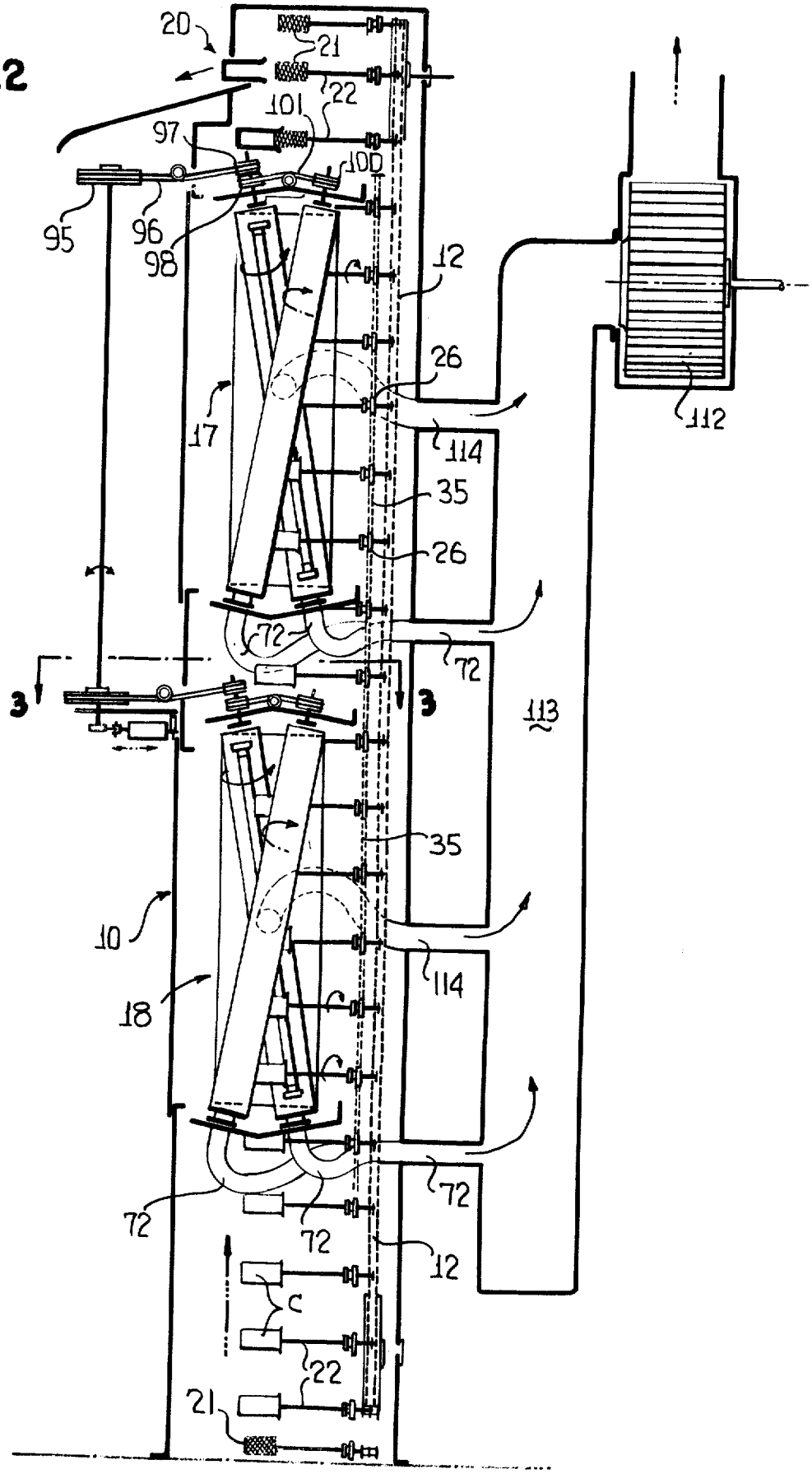
FIG. 2 is a highly schematic view looking from right-to-left in FIG. 1 of the curing oven, and illustrates the askewed relationship of both pairs of ultraviolet lamps relative to the path of conveyor travel, and means for imparting rotation to the lamps through 180°.

Reference is made to FIG. 2 of the drawings which illustrates the shaft 82 projecting above the pulley 81 and having connected to its upper end a pulley 95 which in turn has entrained thereabout a cable 96 identical to the cable 80 which is in turn entrained about a pulley 97 above a pulley 98 corresponding to the pulleys 77,78 of the mechanism shown in FIGS. 3 and 4. Another pulley 100 identical to the pulley 76 is keyed to the other lamp shaft and has entrained thereabout a cable 101 which is also entrained about the cable 98 and a pulley identical to the pulley 90 (not shown). Thus in effect the illustrated components 95 through 98, 100 and 101, and those not illustrated, are identical to the components illustrated in FIG. 4. Thus, the same 90 degree rotation imparted to the shaft 82 is transmitted to the lamps of the pair 17 to likewise achieve the simultaneous 180° rotation of these as are imparted to the pairs 18. Mounted behind each ultraviolet lamp of each pair 17,18 is an air-cooled heat sink 110,111 respectively, as is best illustrated in FIGS. 3 and 4 of the drawings. These head sinks are simply hollow chambers constructed from aluminium or like high heat conducting material which are air-cooled by means of a fan or blower 112 (FIG. 2) which is connected by a manifold 113 and a plurality of flexible conductors 114 to the interior of the heat sinks 110,111. The same blower 112 and manifold 113 are also connected to the conduit 72 to thereby maintain air circulation from the oven interior to the exterior thereof in order to maintain temperatures within the oven as desired.

While preferred forms and arrangements of parts have been shown in illustrating the invention, it is to be clearly understood that various changes in detail and arrangement of parts may be made without departing from the spirit and scope of this disclosure.

I claim:

1. Apparatus for drying articles comprising a housing, conveying means for conveying articles along a path of travel in said housing, means for drying articles during the movement thereof in said housing by said conveying means, said drying means being at least a pair of heat sources disposed to normally direct heat toward the path of travel of said conveying means, said pair of heat sources being disposed in opposing relationship to each other on opposite sides of said path of travel, said pair of heat sources having longitudinal axes disposed along but askewed to the path of travel of said conveying means, the skewing of said pair of heat sources being in directions opposite each other, means for redirecting the normal direction of heat application away from said path of travel to prevent heat damage to the articles carried by said conveying means, and said redirecting means including means for rotating said heat sources away from the path of travel of said conveying means about axes generally parallel to said longitudinal axes.

2. The apparatus as defined in claim 1 wherein said rotating means simultaneously rotates said pair of heat sources in opposite directions.

3. The apparatus as defined in claim 2 wherein said rotating means include common endless drive means entrained about said pair of heat sources for imparting said rotation thereto.

4. The apparatus as defined in claim 2 wherein said conveying means carry a plurality of mandrels each adapted to carry thereon an article to be dryed, each mandrel having a shaft journaled for rotation relative to said conveying means, means for rotating each shaft during the motion of said conveying means, said rotating means including a sprocket carried by each shaft adapted for meshing engagement with a generally stationary rack, means for aligning each sprocket for meshing engagement with said stationary rack, said aligning means including cam means preceeding said stationary rack, and cam follower means carried by each shaft for engaging said cam means and being rotated thereby thus imparting rotation to said sprockets for aligning teeth thereof for meshing engagement with said stationary rack.

5. The apparatus as defined in claim 4 wherein said cam follower means includes a uniplanar surface adapted for sliding movement along said cam means.

6. The apparatus as claimed in claim 4 including means for biasing said cam means toward said cam follower means.

7. The apparatus as defined in claim 4 including at least a pair of links for pivotally mounting said cam means for movement toward and away from said cam follower means.

8. The apparatus as defined in claim 4 including means mounting said generally stationary cam means for movement sufficient to compensate for initial infeed misalignment between said sprockets and said cam means, and said mounting means include spring biasing means for permitting compensatory movement of said cam means generally parallel to said conveying means.

9. Apparatus for drying articles comprising means defining a heating chamber for drying articles conveyed therethrough, means for conveying articles through said heating chamber, said conveying means carrying a plurality of mandrels each adapted to carry thereon an article to be dryed, each mandrel having a shaft journaled for rotation relative to said conveying means, means for rotating each shaft during the motion of said conveying means, said rotating means including a sprocket carried by each shaft adapted for meshing engagement with a generally stationary rack, means for aligning each sprocket for meshing engagement with said stationary rack, said aligning means including cam means preceeding said stationary rack, and cam follower means carried by each shaft for engaging said cam means and being rotated thereby thus imparting rotation to said sprockets for aligning teeth thereof for meshing engagement with said stationary rack.

10. The apparatus as defined in claim 9 wherein said cam follower means includes a uniplanar surface adapted for sliding movement along said cam means.

11. The apparatus as defined in claim 9 including means for biasing said cam means toward said cam follower means.

12. The apparatus as defined in claim 9 including at least a pair of links for pivotally mounting said cam means for movement toward and away from said cam follower means.

13. The apparatus as defined in claim 9 including means mounting said generally stationary cam means for movement sufficient to compensate for initial infeed misalignment between said sprockets and said cam means, and said mounting means include spring biasing means for permitting compensatory movement of said cam means generally parallel to said conveying means.

14. The apparatus as defined in claim 10 including means for biasing said cam means toward said cam follower means.

15. The apparatus as defined in claim 10 including at least a pair of links for pivotally mounting said cam means for movement toward and away from said cam follower means.

16. The apparatus as defined in claim 10 including means mounting said generally stationary cam means for movement sufficient to compensate for initial infeed misalignment between said sprockets and said cam means, and said mounting means include spring biasing means for permitting compensatory movement of said cam means generally parallel to said conveying means.

17. The apparatus as defined in claim 11 including at least a pair of links for pivotally mounting said cam means for movement toward and away from said cam follower means.

18. The apparatus as defined in claim 11 including means mounting said generally stationary cam means for movement sufficient to compensate for initial infeed misalignment between said sprockets and said cam means, and said mounting means include spring biasing means for permitting compensatory movement of said cam means generally parallel to said conveying means.

19. The apparatus as defined in claim 16 including at least a pair of links for pivotally mounting said cam means for movement toward and away from said cam follower means.

20. The apparatus as defined in claim 17 including means mounting said generally stationary cam means for movement sufficient to compensate for initial infeed misalignment between said sprockets and said cam means, and said mounting means include spring biasing means for permitting compensatory movement of said cam means generally parallel to said conveying means.

* * * * *